US008393269B2

(12) United States Patent
Kummet et al.

(10) Patent No.: US 8,393,269 B2
(45) Date of Patent: Mar. 12, 2013

(54) PRINTING PRESS HAVING AT LEAST ONE MACHINE UNIT WITH AT LEAST ONE OF A POWER LINE AND A DATA LINE INSTALLED IN THE AT LEAST ONE MACHINE UNIT

(75) Inventors: Andreas Kummet, Zell am Main (DE); Burkhard Hubert Heinrich Rachor, Kurnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 13/265,571

(22) PCT Filed: Apr. 28, 2010

(86) PCT No.: PCT/EP2010/055687

§ 371 (c)(1),
(2), (4) Date: Oct. 21, 2011

(87) PCT Pub. No.: WO2010/127972

PCT Pub. Date: Nov. 11, 2010

(65) Prior Publication Data

US 2012/0037021 A1 Feb. 16, 2012

(30) Foreign Application Priority Data

May 8, 2009 (DE) ..... 10 2009 002 936

(51) Int. Cl.
*B41F 5/00* (2006.01)
*B41F 7/02* (2006.01)

(52) U.S. Cl. ..... 101/216; 101/217

(58) Field of Classification Search ..... 101/216, 101/217, 219, 479, 480; 100/137, 155 R, 100/160, 176
See application file for complete search history.

(56) References Cited

U.S. PATENT DOCUMENTS

| | | | | |
|---|---|---|---|---|
| 5,727,465 | A * | 3/1998 | Kelm et al. | 101/216 |
| 7,926,420 | B2 | 4/2011 | Kubert et al. | |
| 2001/0017088 | A1 | 8/2001 | Dilling et al. | |
| 2001/0029854 | A1 * | 10/2001 | Gottling et al. | 101/216 |
| 2002/0178936 | A1 * | 12/2002 | Williams | 100/155 R |
| 2005/0055917 | A1 | 3/2005 | Dubensky et al. | |
| 2008/0022877 | A1 | 1/2008 | Gail et al. | |

FOREIGN PATENT DOCUMENTS

| | | | |
|---|---|---|---|
| DE | 30 47 765 | A1 | 9/1982 |
| DE | 10261274 | A1 | 7/2004 |
| DE | 20 2006 011 613 | U1 | 11/2006 |
| DE | 10 2007 000 863 | A1 | 4/2009 |
| GB | 2 359 783 | A | 9/2001 |

* cited by examiner

*Primary Examiner* — Judy Nguyen
*Assistant Examiner* — Blake A Tankersley
(74) *Attorney, Agent, or Firm* — Mattingly & Malur, P.C.

(57) ABSTRACT

A printing machine or press including at least one printing unit having at least one frame wall. The at least one frame wall defines a machine space of the machine unit. The at least one frame wall has a thickness and includes a narrow side. At least one passage is formed in the frame wall and is at least partially open. The at least one passage is formed on at least one surface of the frame wall and with its surface opening disposed on the narrow side of the frame wall and which extends along the surface of the frame wall. At least one of a power line and a data line can be disposed in the passage.

42 Claims, 7 Drawing Sheets

PRINTING PRESS HAVING AT LEAST ONE MACHINE UNIT WITH AT LEAST ONE OF A POWER LINE AND A DATA LINE INSTALLED IN THE AT LEAST ONE MACHINE UNIT

CROSS-REFERENCE TO RELATED APPLICATIONS

This application is the U.S. national phase, under 35 U.S.C. 371, of PCT/EP2010/055687, filed Apr. 28, 2010; published as WO 2010/127972 A1 on Nov. 11, 2010 and claiming priority to DE 10 2009 002 936.2 filed May 8, 2009, the disclosures of which are expressly incorporated herein by reference.

FIELD OF THE INVENTION

The invention relates to a printing press having at least one machine unit The machine unit has at least one frame wall that delimits a machine space in the machine unit. Within this at least one frame wall, which has a wall thickness, there is provided at least one passage that is at least partially open. The passage is formed on at least one surface of the frame wall. The surface that opens the passage is disposed on a narrow side of the frame wall.

BACKGROUND OF THE INVENTION

From DE 102 61 274 A1, a frame section for a base frame of an industrial system having a profiled part that is open toward one side is known, wherein the profiled part is embodied as a cable chute for laying at least one electrical cable, and has at least one reinforcing part, fastened in the profiled part, to which a holding device for raising the industrial system is attached, said reinforcing part having an opening through which the electrical cable can be guided, wherein the opening in the reinforcing part is open on at least one side of the reinforcing part such that the electrical cable can be inserted from that side into the opening in the reinforcing part.

From DE 30 47 765 A1, a pedestal structure is known, wherein a tub-like device, in this case called a pedestal, accommodates a pipe, wherein narrower pipes are placed inside a pipe that is connected to the pedestal, or other pipes are telescoped into each other and securely connected to one another, wherein lines are laid inside the pipes.

From US 2005/0055917 A1, a corner connecting piece for a frame of an air handling unit is known, wherein this corner connecting piece comprises an element, which comprises a first section, a second section and a third section, wherein the first section, the second section and the third section each have a first leg and a second leg, wherein the first leg of the first section and the second leg of the second section form a first edge, wherein the second leg of the first section and the first leg of the third section form a second edge, and wherein the first leg of the second section and the second leg of the third section form a third edge, wherein the first edge, the second edge and the third edge form a corner, wherein ends of the first opposite edge, the second edge and the third edge are assembled to form the corner of the frame.

SUMMARY OF THE INVENTION

The problem addressed by the invention is that of providing a printing press having at least one machine unit, wherein at least one power line and/or at least one data line can be installed in this machine unit, and at least one control unit and/or operating unit and/or display unit can optionally be positioned in a simple manner.

The problem is solved according to the invention by the provision of the passage in the narrow side of the frame wall of the at least one machine unit. This passage, which is at least partially open, is used to receive at least one of a power line and a data line. A plurality of such lines can be disposed in this at least one passage.

The advantages to be achieved by the invention consist particularly in that at least one power line and/or at least one data line can be installed, and at least one control unit and/or operating unit and/or display unit can optionally be positioned in a simple manner, despite a highly compact construction of the machine unit. An installation system for a machine unit of a printing press is provided, which avoids the use of attached passages for routing lines and/or minimizes the routing of lines inside the machine space of this machine unit. This system also eliminates a majority of the expense that has heretofore been necessary for installing fastening means, such as line clamps, along the routing paths of lines, particularly inside the machine space of this machine unit. Instead, the passages that are formed integrated into a frame wall and/or crosspiece allow a time-saving installation of preassembled line strands, for example, because numerous fasteners for these lines, which need only to be placed inside the passages, are eliminated, for example.

Advantageously, the entire installation of lines and the positioning of control units and/or operating units and/or display units can be carried out during assembly of the relevant machine unit, by the manufacturer of the machine unit in its assembly plant, and not on the customer's premises, i.e., in a print shop, for example. By preassembling the lines and the control units and/or operating units and/or display units, the printing press can be set up more quickly on the customer's premises, and can be placed in operation within a shorter time.

The at least partial positioning of particularly operating units and/or display units inside passages formed integrated into the frame walls facilitates the exchange of these operating units and/or display units between the different operating sides of the relevant machine unit, since costly structural measures are not required for this.

For example, control units can be positioned in a crosspiece in a simple manner in that, in the relevant machine unit, consumers, which are arranged particularly symmetrically to the direction of transport of the print substrate guided through the printing press, can be connected particularly to lines, approximately equal in length, for conducting a fluid, thereby minimizing time delays in the actuation of these consumers by the relevant control unit. Unduly long line routes are avoided.

If necessary, lines for conducting a fluid can be separated in a simple manner from electric power cables, by means of a special embodiment of the passages.

Because the passages formed integrated into the frame walls and/or crosspieces are preferably covered by a removable cover, they can still be easily accessed by a press operator, for example, in the event of a breakdown, for example.

By forming the passages for routing the lines in fixed members that project outward from the frame wall, a highly advantageous reinforcement particularly along the vertical direction of these frame walls is achieved, particularly if the frame walls are made of cast iron and have a height of more than 2,000 mm. Frame walls of this type, due to their manufacturing process, and due to the machining that is necessary to produce them, tend to become warped; however, this is intolerable, particularly in a printing unit, which has a highly precise configuration of a multiplicity of bearing positions for cylinders and/or rollers that will interact in a printing process and will be arranged in the printing unit.

BRIEF DESCRIPTION OF THE DRAWINGS

Embodiment examples of the invention are illustrated in the set of drawings and will be specified in greater detail in what follows.

The drawings show.

DESCRIPTION OF THE PREFERRED EMBODIMENT

Figure 1:
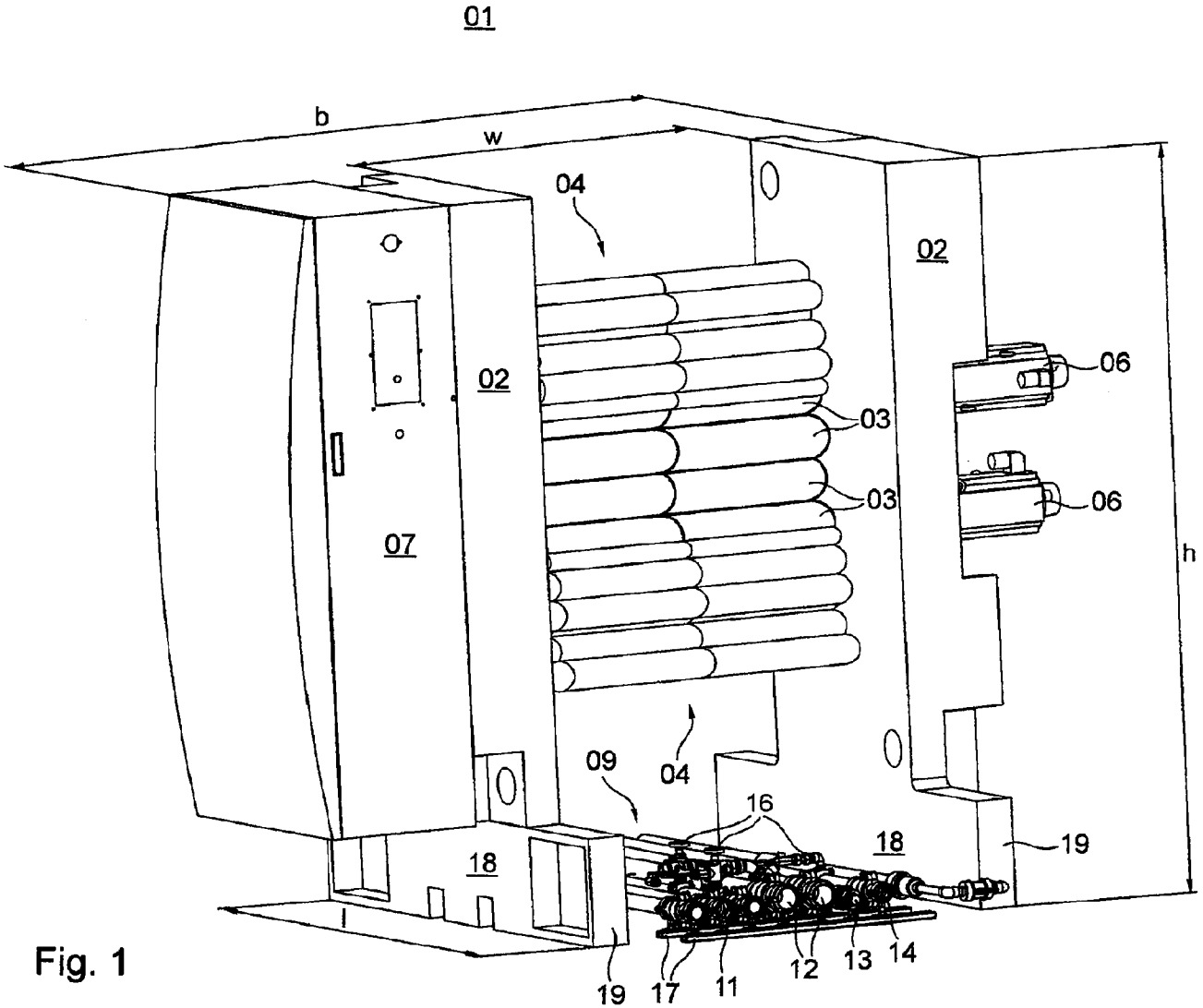
FIG. 1 a machine unit embodied as a printing unit of a printing press.

A printing press, preferably a rotary printing press, more particularly, a commercial printing press, is advantageously modular in construction, in that it has a plurality of machine units 01, some of which are identical, wherein each of the machine units 01, also called modules, belonging to this printing press executes at least one specific step in a processing and/or production process to be carried out by said printing press. One such module, embodied by way of example as a printing unit, is illustrated in simplified form in FIGS. 1 to 4, in each case in a perspective view, wherein in this example, a print substrate 31 (FIG. 5), for example, a material web, more particularly, a paper web, is guided or at least can be guided substantially horizontally through the illustrated printing unit and then preferably through additional printing units, arranged in a row in the direction of transport T of the print substrate 31, which units are essentially identical in construction to the illustrated printing unit, and said print substrate is thereby subjected to at least one specific step in the overall processing and/or production process to be carried out. To form a printing press that is capable of producing printed products, a plurality of modules belonging to that printing press are assembled, more particularly, arranged in a row, in a print shop, for example, wherein each of a plurality of modules is preferably embodied as a printing unit. Additional modules belonging to this printing press can be embodied, for example, as a reel changer, as an infeed unit, as a coating unit, as a dryer, or as a folding apparatus. Each of these modules is preferably manufactured as a self-contained functional component, and is installed and tested with respect to its specific function, particularly by the manufacturer of the printing press, before being delivered to a customer.

At least one machine unit 01 of the printing press, but preferably a plurality of the machine units 01 thereof, have at least one frame wall 02, which delimits a machine space of the relevant machine unit 01. Preferably, a pair of individually manufactured frame walls 02 is provided, for example, which are positioned opposite one another and are used particularly as side frames. The at least one frame wall 02 is preferably embodied as an upright, substantially rectangular geometric body, the thickness d of which (FIG. 3) is significantly smaller than the height h or length l thereof (FIG. 1), wherein the thickness d of the frame wall 02 extends transversely to the direction of transport T of the print substrate 31.

In the machine space of the relevant machine unit 01, for example, between the frame walls 02 thereof, which are spaced relative to one another, at least one cylindrical rotational body 03 is arranged, the outer surface of which can be involved in processing the print substrate 31 as it is guided through the printing press, wherein this rotational body 03 is embodied as a printing couple cylinder, for example. Preferably, a plurality of printing couple cylinders is arranged there, particularly axially parallel to one another. Additional rotational bodies 03, each in the form of a roller of an inking unit 04 or in the form of a roller of a dampening unit, for example, can be arranged in the machine space of the relevant machine unit. To the extent that the printing press operates using an offset printing process, at least one of the printing couple cylinders is embodied as a transfer cylinder and at least one other printing couple cylinder is embodied as a forme cylinder assigned to the transfer cylinder, wherein the transfer cylinder rolls off against an impression cylinder, which is in turn also embodied as a transfer cylinder, for example, and also interacts with at least one additional forme cylinder so as to enable imprinting of the print substrate 31 on both sides simultaneously, wherein the print substrate 31 is guided through a printing gap formed by the two transfer cylinders rolling off against one another.

In the example illustrated in FIGS. 1 to 4, four rotational bodies, each embodied as a printing couple cylinder, more specifically, two pairs, each consisting of one transfer cylinder and one forme cylinder, are arranged substantially vertically, one above the other, in the printing press, although they are offset relative to one another by an acute angle in relation to vertical, wherein an inking unit 04 consisting of a plurality of rollers, and optionally also a dampening unit, is engaged against each of the two forme cylinders. In each case at least one printing forme is disposed, or at least can be disposed on the outer surface of at least one, and preferably of each forme cylinder, and if the printing press is embodied as a commercial printing press, precisely one single printing forme spans the relevant forme cylinder. Each of the transfer cylinders is covered or at least can be covered on its outer surface with at least one printing blanket, for example, a rubber packing, preferably a metal printing blanket.

Figure 2:
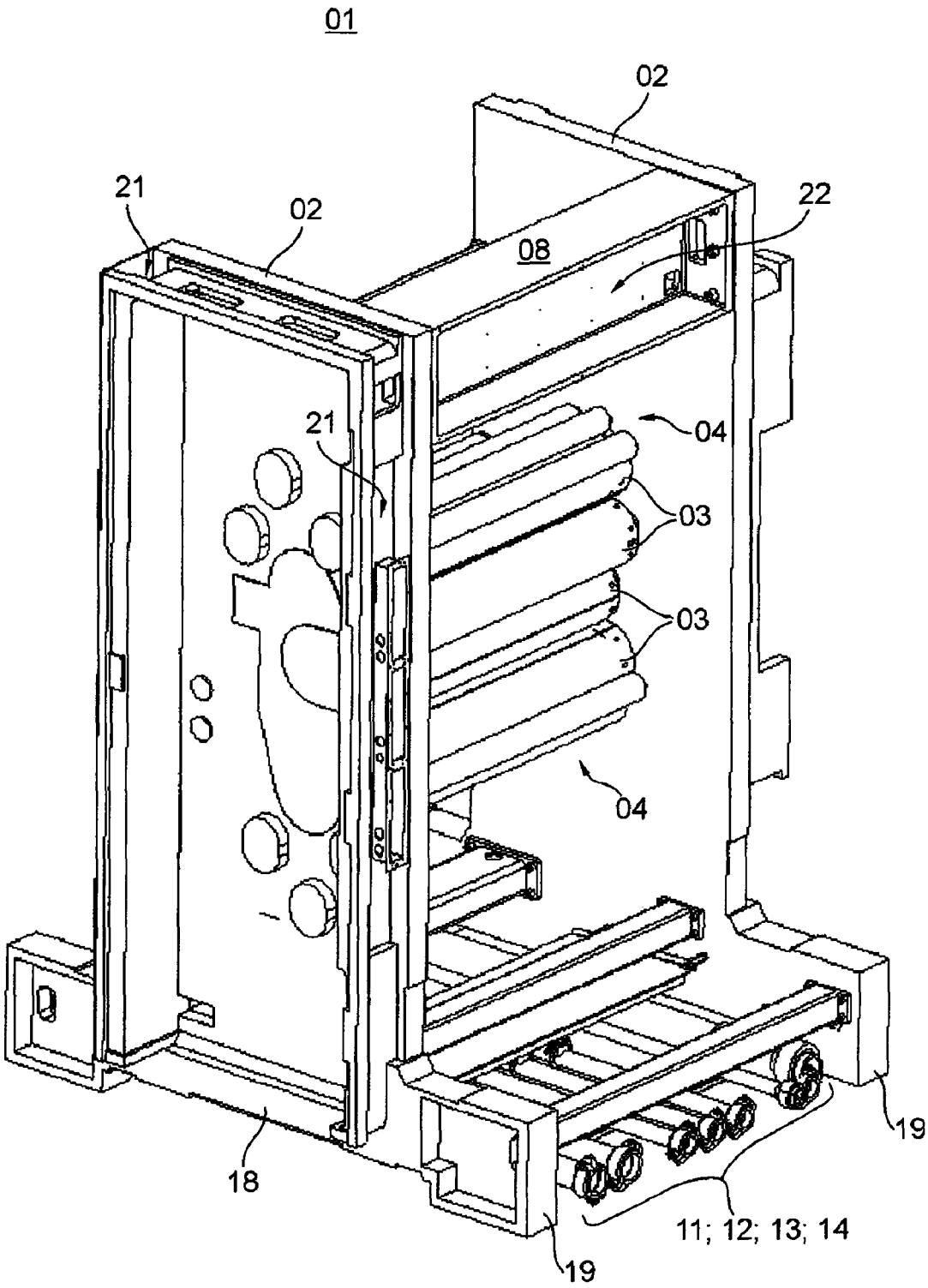
FIG. 2 a first perspective illustration of the machine unit of FIG. 1.
Figure 3:
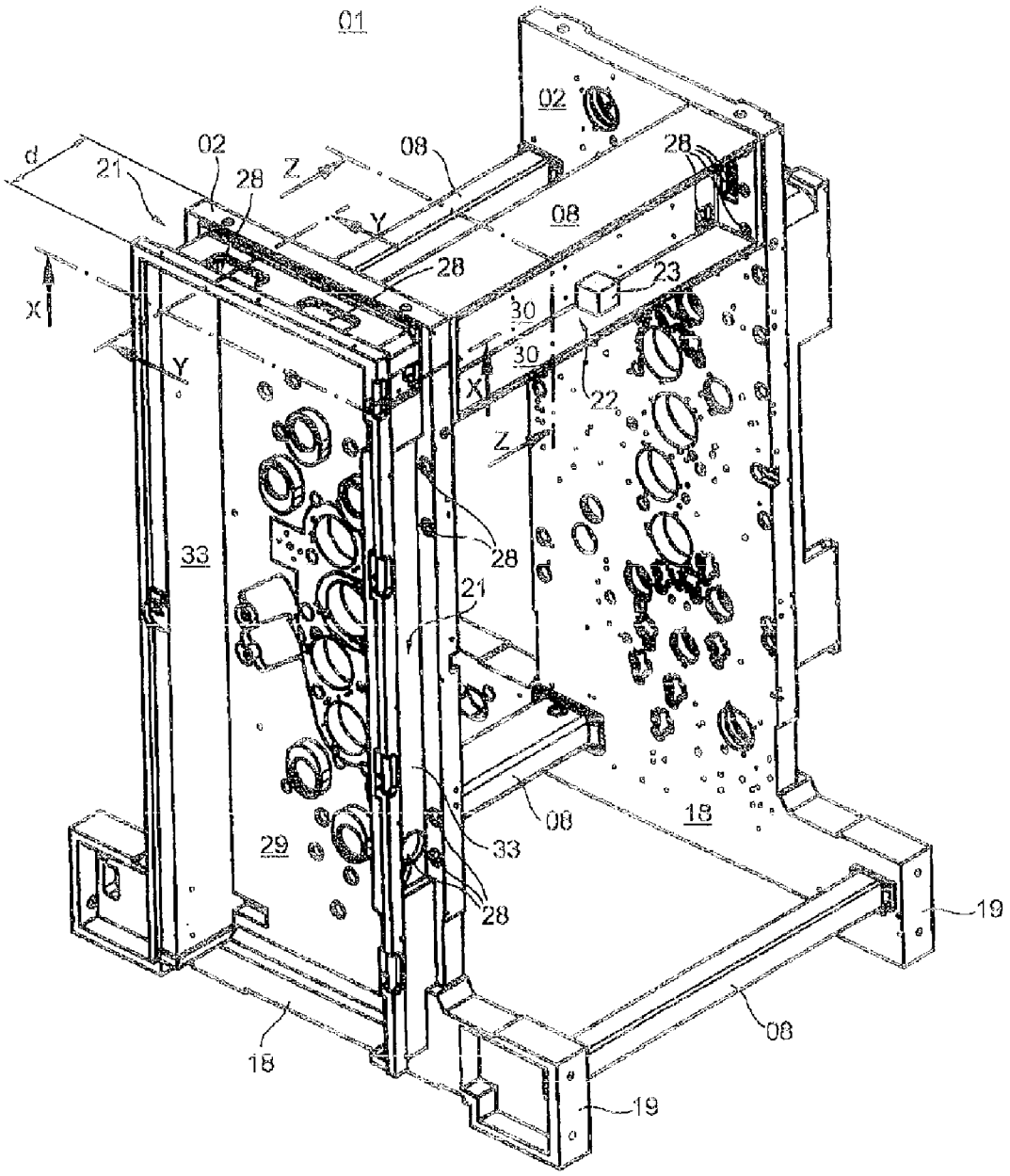
FIG. 3 frame walls and crosspieces of the machine unit of FIG. 1.
Figure 4:
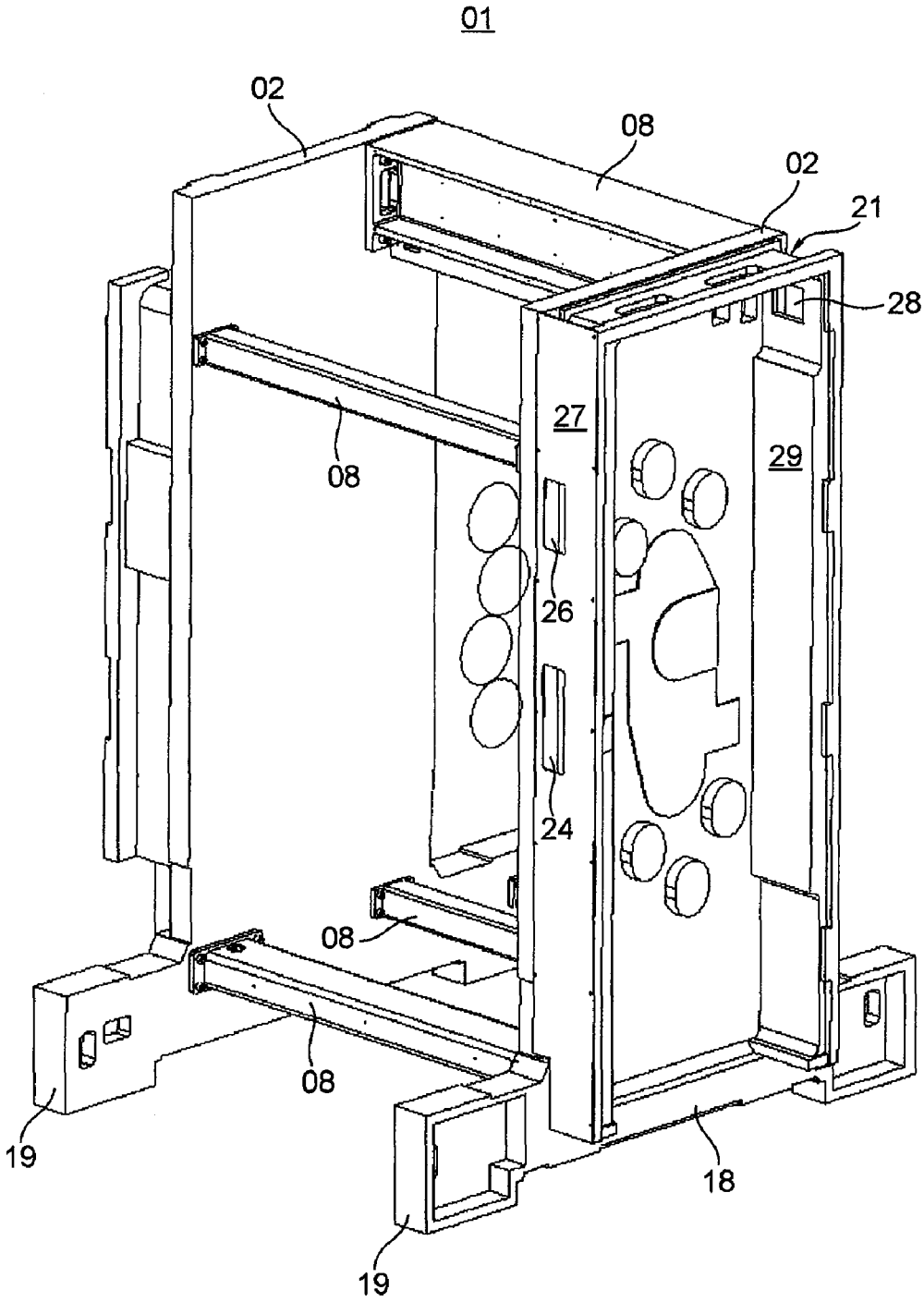
FIG. 4 a second perspective illustration of the machine unit of FIG. 1.

The printing couple cylinders are driven, or at least can be driven, by at least one drive 06 positioned on one of the frame walls 02, wherein this drive 06 is located outside of the machine space that contains the printing couple cylinders and at least the one inking unit 04. One drive 06 is preferably assigned to the pair which is the lower pair in relation to the print substrate 31 that can be guided horizontally through the printing gap of the printing unit, and which pair consists of a transfer cylinder and a forme cylinder that interacts with it, wherein the drive transfers its torque to the respective rotational axes R of this transfer cylinder and forme cylinder by means of a transmission located in a transmission space of the machine unit 01. The transmission space is located, for example, in or on the frame wall 02 of the machine unit 01 that in FIGS. 2 to 4 is the front wall. The drive 06 preferably acts directly on the rotational axis R of the forme cylinder, which drives the associated transfer cylinder via the transmission. The same applies similarly to the pair of one transfer cylinder and one forme cylinder which is the upper pair in relation to the print substrate 31 that can be guided horizontally through the printing gap of the printing unit. Each of the drives 06 is preferably embodied as an electric motor, for example, as a motor that can be controlled with respect to its speed and with respect to its angular position, wherein, the control of angular position relates to a rotational angle position relative to at least one printing couple cylinder that is driven by a different drive 06.

In a machine unit 01 having a pair of frame walls 02, a control cabinet 07, particularly an electric control cabinet 07, is preferably provided on the frame wall 02 that is opposite the drives 06, outside of the machine space in which the printing couple, which is formed by the printing couple cylinder and at least one inking unit 04, and optionally also a dampening unit, is located, preferably directly on the relevant frame wall 02, wherein electric control and/or regulating units for the operation of this printing unit are disposed inside this control cabinet 07. At least one electric drive controller, which controls the drive or drives 06 provided for the printing couple cylinders, is preferably located inside this control cabinet 07. If the two drives 06 located in the same printing unit are controlled separately from one another, each by its own drive controller, then these two drive controllers are generally smaller in structure than one drive controller that is shared by the two drives 06, and in most cases they also produce comparatively less exhaust heat, and therefore, the two separate drive controllers can be integrated more easily into the same control cabinet 07. Additionally, separate drives 06 for the upper and lower printing couples of the same printing unit 01 enable a simultaneous, i.e., synchronous changing of at least one printing forme on each of the two forme cylinders of this printing unit, because the respective angular positions of the two forme cylinders can particularly be adjusted separately from one another.

Between the frame walls 02 arranged opposite one another, i.e., transversely to the direction of transport T of a print substrate 31 that can be guided through this printing unit, at least one crosspiece 08 is located. Preferably, a plurality of crosspieces 08 are arranged there (FIGS. 2 to 4), which space the two interacting frame walls 02 from one another and stabilize the structure of the relevant printing unit. In the interest of clarity, these crosspieces 08 are not illustrated in FIG. 1.

The machine unit 01, embodied here by way of example as a printing unit, has a height h ranging from 2,300 mm to 4,000 mm, for example, preferably ranging from 2,400 mm to 2,700 mm, and a width b, extending transversely to the direction of transport T of the print substrate 31, ranging from 2,000 mm to 3,000 mm, preferably approximately 2,500 mm, and a length l, extending in the direction of transport T of the print substrate 31, ranging from 1,500 mm to 3,500 mm, preferably approximately 2,000 mm. A distance w identified as the inside width between opposite frame walls 02 measures 1,000 mm to 1,800 mm, for example, more particularly, 1,200 mm to 1,300 mm. A printing unit of this type has a mass ranging from 4 to 10 tons, preferably approximately 6 tons. The thickness d, oriented transversely to the direction of transport T of the print substrate, of each frame wall 02 is less than 20% of the width b of the machine unit 01, for example. The thickness d of each frame wall 02 is preferably between 5% and 15% of the width b of the associated machine unit 01.

In a floor area 09 of the printing unit, located below the printing couple between the opposite frame walls 02, a plurality of pipelines 11; 12; 13; 14 are laid parallel to one another (FIGS. 1; 2), extending along the length l of this printing unit in the direction of transport T of the print substrate 31, wherein these pipelines 11; 12; 13; 14, which are preferably arranged side by side transversely to the direction of transport T of the print substrate 31 that can be guided through the printing press, serve to supply media to the printing unit, wherein the respective medium is embodied as fluid and liquid or gaseous. More particularly, pipelines 11, for example, for transporting cooling medium, for example, water, for cooling heat exchangers located inside the control cabinet 07, are provided, along with pipelines 12, for example, for transporting a cooling medium, for example, water, for controlling the temperature of rollers of the at least one inking unit 04 in this printing unit. Also provided are pipelines 13, for example, for supplying compressed air to the at least one printing couple in this printing unit, and optionally, pipelines 14, for example, for the return of a dampening agent used in the printing couple. Optionally, pipelines for supplying and optionally disposing of fluid in a blanket washing system or a pneumatic image corrector, for example, may be added. Each of the pipelines 11; 12; 13; 14 is equipped at each of its ends with a coupling, for example, preferably with a quick-release coupling, in order to allow these pipelines 11; 12; 13; 14 to be quickly assembled in a row when a plurality of these printing units, each equipped with pipelines 11; 12; 13; 14, are to be assembled in a row. At least one of these pipelines 11; 12; 13; 14, but preferably all of these pipelines 11; 12; 13; 14, are connected via at least one branch 16 (FIG. 1), which may have a pipe connection and/or a shut-off valve, to at least one unit located in this printing unit, i.e., to at least one consumer, for example, a cooling unit or temperature control unit, or to a pneumatic consumer, or to at least one source, for example, a dampening agent source. All of the above-described pipelines 11; 12; 13; 14 are preassembled at the factory of the printing unit manufacturer, and are fully linked to their respective consumers or sources located inside the printing unit. A pipeline for supplying ink to the inking unit 04 is preferably not routed in connection with the pipelines 11; 12; 13; 14 disposed in the floor area 09 of the printing unit 01, and is instead routed above the printing unit 01, for example, thereby facilitating access to the ink supply. It can be provided that an oil pump and/or a heat exchanger are arranged in or on one of the frame walls 02 of this printing unit, for example, which represents a space-saving configuration for units of this type. The oil pump and/or the heat exchanger are particularly connected to at least one of the pipelines 11; 12; 13; 14 disposed in the floor area 09 of the module.

The pipelines 11; 12; 13; 14 of each printing unit 01 can be fixed in place in their respective positions by one or more fastening devices 17, which extend across the width b of the printing unit. The fastening devices 17 preferably also connect the assembly of pipelines 11; 12; 13; 14 to the two opposite frame walls 02. The pipelines 11; 12; 13; 14 of each printing unit extend parallel to longitudinal crosspieces 18, formed on each of the frame walls 02 in the lower region thereof, preferably formed seamlessly thereon. In a printing press consisting of a plurality of modules arranged in a row, the pipelines 11; 12; 13; 14 extend, preferably in a straight line, through the continuous floor area 09 formed by a plurality of modules, for example, a plurality of printing units of this printing press, more particularly, from an infeed unit of this printing press up to its dryer.

On at least one crosspiece 08, which extends transversely to the direction of transport T of the print substrate 31, at least one control unit 23 is disposed (FIG. 3), for example, which controls the distribution of compressed air, for example, to pneumatic consumers located in the printing unit. These pneumatic consumers can be operating cylinders or control cylinders, for example, or particularly roller locks, wherein one roller lock serves as a mount for one end of a rotational body 03 belonging to the machine unit 01, preferably a roller, more particularly, a roller of an inking unit 04 or of a dampening unit. Roller locks each have a plurality of pneumatic actuators, for example, three or four, with which, i.e., with the impingement of which by compressed air, controlled by the control unit 23, the position of the respective roller can be displaced radially, and its radial stroke adjusted. It is advantageous to position the at least one control unit 23 for controlling pneumatically operated roller locks, disposed at different ends of the same rotational body 03, in or on the crosspiece 08 approximately centered between the frame walls 02 that delimit the machine space of the machine unit 01. In that case, consumers arranged symmetrically between the frame walls 02, such as roller locks disposed at both ends of the same roller, for example, can be supplied with compressed air by the control unit 23 via lines having at least nearly the same length. This centered arrangement ensures improved synchronization, for example, of the linear travel of operating cylinders, control cylinders, and/or roller locks that are actuated by compressed air. Positioning the pipelines in the floor area 09 of the printing unit supports a short line connection to the control unit 23, which is preferably located approximately centered in or on the crosspiece 08.

The at least one frame wall 02 or the frame walls 02 and/or the crosspiece(s) 08 are preferably made of a metallic material, more particularly, of a cast material, for example, of cast iron. The longitudinal crosspieces 18 that delimit the floor area 09 of the machine unit 01 on two parallel sides preferably each have a projection, longitudinally in relation to the pipelines 11; 12; 13; 14, on at least one side of the frame walls 02 that extends parallel to the width b of the machine unit 01, i.e., on an intake side or on an outlet side for the print substrate 31 that can be guided through this machine unit 01. This projection is aligned longitudinally in relation to the direction of transport T of the print substrate 31 that can be fed through this machine unit 01, and projects beyond a part of the frame walls 02 that delimits the printing couple, for example, wherein this projection is preferably formed on the relevant frame wall 02 by casting methods. A frame wall 02 having a single projection formed thereon therefore has the shape of an "L". Preferably, however, at least one such projection is formed on each of the two sides of the frame walls 02 that extend parallel to the width b of the machine unit 01, i.e., on both the intake side and the outlet side for the print substrate 31, in which case the relevant frame wall 02 has the shape of an upside-down "T". Preferably, both frame walls 02 of the same machine unit 01 are embodied in the form of this upside-down "T". In the preferred embodiment, each of a plurality of machine units 01, particularly printing units, in the printing press, and preferably all such units, preferably have a projection as described above both on their respective intake side for the print substrate 31 and on their respective outlet side, each said projection being embodied as a component of the relevant frame wall 02. Each of the frame walls 02 is preferably embodied as forming a single piece, together with its associated longitudinal crosspiece 18 and the at least one projection formed thereon, by means of casting methods.

Each of the projections has at least one vertical fixed stop on its respective end surface, i.e., on its respective joining surface 19 for joining to another module of the printing press, by means of which stop two modules, for example, more particularly, printing units, to be arranged in a row can be aligned in relation to one another, and can actually be joined to one another, aligned with one another with respect to an alignment extending in the direction of transport T of the print substrate 31, as they are being set up at the location of use of the printing press, particularly on the premises of a customer, i.e., in a print shop. In addition to aligning printing units to be arranged in a row, the respective fixed stop can also be used for aligning a printing unit having this fixed stop with another adjacent module of this printing press, for example, a reel changer, an infeed unit, a coating unit, a dryer or a folding apparatus, in the direction of transport T of the print substrate that can be guided through the printing unit, for example, by butting it up against a shared joining site, i.e., directly at a point of contact, and therefore without the interconnection of additional components.

Once a plurality of machine units 01 belonging to the same printing press have been set up in alignment and aligned with one another, the respective pipelines 11; 12; 13; 14 thereof can be coupled to one another via quick-release couplings, for example, or other suitable connecting elements, and thereby connected with one another to form a continuous system for the respective supply of media. The pipelines 11; 12; 13; 14 of at least each of the same type of module of the printing press are preferably embodied as equal in length, specifically, particularly the same length as the longitudinal crosspieces 18, so that the preferably coupleable connections of these modules of the printing press, on the respective intake side thereof for the print substrate 31 and on the respective outlet side thereof, each lie adjacent to one another and end within a coupling plane that extends transversely to the direction of transport T of the print substrate 31.

Accordingly, the printing press preferably consists of a plurality of modules, which are arranged in a row in the direction of transport T of a print substrate 31 that can be guided through this printing press, wherein a plurality of these modules preferably each have a pair of opposite frame walls 02, wherein each of these frame walls 02 preferably has a longitudinal crosspiece 18 oriented in the direction of transport T of the print substrate 31 that can be guided through this printing press, wherein the two longitudinal crosspieces 18 of a pair of opposite frame walls 02 delimit a floor area 09 of this printing press on two parallel sides, wherein the respective longitudinal crosspieces 18 of modules arranged in a row are preferably arranged aligned in a row, and form a floor area 09 that is continuous in the printing press, wherein in the continuous floor area 09 in the printing press, a plurality of pipelines 11; 12; 13; 14 that serve to supply media to the modules of this printing press are disposed, wherein the medium conducted through these pipelines 11; 12; 13; 14 is liquid or gaseous, wherein at least one of the pipelines 11; 12; 13; 14 is connected to at least one unit located in one of the modules of this printing press, i.e., to a consumer to be supplied with the respective medium or to at least one source for supplying the respective medium.

Increased automation of the process steps to be executed in a machine unit 01 of the printing press, in the processing and/or production process to be executed by this printing press with respect to a print substrate 31, results in an increased demand for power lines 38 and/or data lines 39 (FIGS. 6 to 8) in the relevant machine unit 01, which are to be routed to units arranged in the machine unit 01, for example, in the machine space thereof or in the control cabinet 07 thereof, wherein the respective power line 38 is embodied as a cable for conducting electric power or as a line for conducting a fluid, particularly compressed air, and the respective data line 39 is embodied as a line for transmitting a signal electrically or optically or pneumatically. Moreover, an increasing number of control units 23 and/or operating units 24 and/or display units 26 are also required for controlling and/or operating the units located in the machine unit 01 and for displaying the control statuses thereof. On the other hand, modern machine units 01 of a printing press are becoming increasingly compact, and therefore, increasingly less space, i.e., structural space, is available for routing the necessary power lines 38 and/or data lines 39 and for placement of these necessary control units 23 and/or operating units 24 and/or display units 26.

It is therefore proposed to form at least one passage 21 inside at least one frame wall 02 of the relevant machine unit 01 (FIGS. 2 to 5), which passage is embodied as at least partially open on at least one surface of the relevant frame wall 02, wherein the longitudinal direction of this passage 21 extends parallel to the surface of the frame wall 02 that at least partially opens said passage 21, wherein at least one power line 38 and/or at least one data line 39 is disposed or at least can be disposed inside this passage 21. Additionally, at least one control unit 23 and/or at least one operating unit 24 and/or at least one display unit 26 for controlling and/or operating at least one unit located in the machine unit 01 and for displaying the control status thereof can also be positioned in this passage 21, wherein the relevant control unit 23 and/or the relevant operating unit 24 and/or the relevant display unit 26 is positioned at least partially within this passage 21 of the relevant frame wall 02. A partial positioning of the relevant control unit 23 and/or the relevant operating unit 24 and/or the relevant display unit 26 within the passage 21 means that this control unit 23 and/or operating unit 24 and/or display unit 26 projects outward relative to the surface of the relevant frame wall 02, and is not installed completely, for example, recessed, inside the relevant passage 21.

It is also advantageous to provide a passage 22 in at least one crosspiece 08, which bridges the distance w between two opposite frame walls 02 which each delimit the machine space of the machine unit 01 (FIGS. 2; 3), wherein the passage 22 formed inside this crosspiece 08 is also at least partially open on the surface of this crosspiece 08, wherein the longitudinal direction of this passage 22 extends parallel to the surface of the relevant crosspiece 08 that at least partially opens the passage 22, wherein at least one power line 38 and/or at least one data line 39, and if necessary, also at least one control unit 23 and/or at least one operating unit 24 and/or at least one display unit 26 for controlling and/or operating at least one unit located in the machine unit 01 and for displaying the control status thereof are also arranged or at least can be arranged inside this passage 22. The passage formed in the relevant frame wall 02 and the passage 22 of the at least one crosspiece 08 are preferably connected continuously to one another, thereby creating a system of passages 21; 22 that are connected to one another, wherein at least one power line 38 and/or at least one data line 39, but preferably at least one strand of such power lines 38 and/or data lines 39, is routed or at least can be routed in these passages 21; 22 that are connected to one another. At least one control unit 23 for controlling a pneumatically operated operating cylinder or control cylinder and/or for controlling at least one pneumatically operated roller lock is located in the passage 22 of the crosspiece 08, for example, wherein a control unit 23 used particularly for controlling pneumatically operated roller locks disposed at different ends of the same rotational body 03 is preferably positioned at least approximately centered, i.e., in a position characterized as ranging from 40% to 60% of the distance between the frame walls 02 that delimit the machine space of the machine unit 01.

The passage 21 formed in the relevant frame wall 02 is preferably embodied as a channel recessed into a narrow side 32 of this frame wall 02 or formed therein, wherein this channel can have an at least partially round or angular cross-section orthogonally to its longitudinal direction. The passage 22 of the at least one crosspiece 08 is also preferably embodied in the form of a channel. Because the frame wall 02 and/or the crosspiece 08 are preferably made of a cast material, each passage 21; 22 formed inside the frame wall 02 or inside the crosspiece 08 is preferably formed there by means of casting methods. Once the at least one power line 38 and/or the at least one data line 39 has been laid in the passage 21 of the relevant frame wall 02 and/or once at least one control unit 23 and/or at least one operating unit 24 and/or at least one display unit 26 for controlling and/or operating at least one unit located in the machine unit 01 and for displaying the control status thereof has also been positioned within this passage 21, that passage 21 is covered with a preferably removable cover 24, for example, with a sheet metal cover that can particularly be attached with screws (FIG. 4). The same applies similarly to the passage 22 formed in the crosspiece 08.

In the preferred embodiment, the passage 21 formed in the relevant frame wall 02 and/or the passage 22 in the at least one crosspiece 08 are each separated by a panel 29 preferably of the relevant frame wall 02 or a panel 30 of the relevant crosspiece 08 from the machine space of the machine unit 01 and/or from a transmission space that is connected to at least one drive 06 belonging to the machine unit 01, wherein the relevant panel 29; 30 can have at least one opening 28 at individual points in the respective passage 21; 22 (FIG. 3), to allow at least one power line 38 and/or at least one data line 39 to be routed out of the relevant passage 21; 22, for example, to a control cabinet 07 positioned on the relevant frame wall 02 or to a unit of this machine unit 01. A power line 38 and/or a data line 39 or a strand of such lines can be effectively routed through the relevant opening 28 without damage and, for example, without forming a plug-type connection. Therefore, in relation to the at least one power line 38 and/or data line 39 routed in the relevant passage 21; 22, for example, at least one stub line is provided in each case, which branches off of the at least one power line 38 or data line 39 disposed in the passage 21; 22 formed inside the frame wall 02 or inside the crosspiece 08. To increase operational reliability, a dividing wall is preferably provided in the passage 21; 22 formed inside the frame wall 02 or inside the crosspiece 08, which dividing wall divides the respective passage 21; 22 longitudinally into two partial passages, wherein at least one line for conducting electric power or an electrical signal is disposed in one partial passage, and at least one line for conducting a fluid is disposed in the other partial passage.

FIG. 5 again schematically illustrates the geometric proportions of the passages 21; 22 formed in at least one frame wall 02 and/or at least one crosspiece 08. In the machine unit 01 illustrated by way of example, two vertically erect, opposite frame walls 02 are provided, one frame wall 02 of which is only partially shown. The two frame walls 02 are connected to one another by at least one crosspiece 08, thereby joining these frame walls 02 to form an interconnected component. The two frame walls 02 delimit a machine space that is bridged by the crosspiece 08, in which space at least one cylindrical rotational body 03, for example, a printing couple cylinder or a roller particularly of an inking unit or a dampening unit, the outer surface of which is involved or at least can be involved in the process of processing a print substrate 31 that is guided through the printing press, is disposed or at least can be disposed. The rotational axis R of the rotational body 03 is positioned substantially orthogonally to the direction of transport T of the print substrate 31 that is guided through the machine unit 01. Each of the frame walls 02 has at least one passage 21, which is at least partially open on at least one surface of the relevant frame wall 02 and is embodied as integrated therein, wherein the longitudinal direction of each passage 21 extends parallel to the surface of the frame wall 02 that at least partially opens the passage 21, wherein at least one power line 38 and/or at least one data line 39 is disposed or at least can be disposed inside the relevant passage 21. At least in the case of one of the frame walls 02 illustrated here by way of example, the surface that opens the passage 21 is located on one of preferably a plurality of narrow sides 32, for example, three, of the relevant frame wall 02, which are different from a base surface, wherein a surface normal N that extends perpendicularly on the narrow side 32 that opens the relevant passage 21 is preferably positioned orthogonally to the rotational axis R of the rotational body 03 that is disposed or at least can be disposed within the machine space. Generally, no passage 21 is integrated into the floor area, i.e., into the contact surface for the frame wall 02. One narrow side 32 of the relevant frame wall 02 has a surface, the extension of which in one direction in space is limited by the measurement of the thickness d of the relevant frame wall 02. A perimeter surface of the relevant frame wall 02 can extend, following the profile of the relevant passage 21, along a plurality of adjoining narrow sides 32, for example, three, of the same relevant frame wall 02, said sides following continuously one behind the other.

Figure 5:
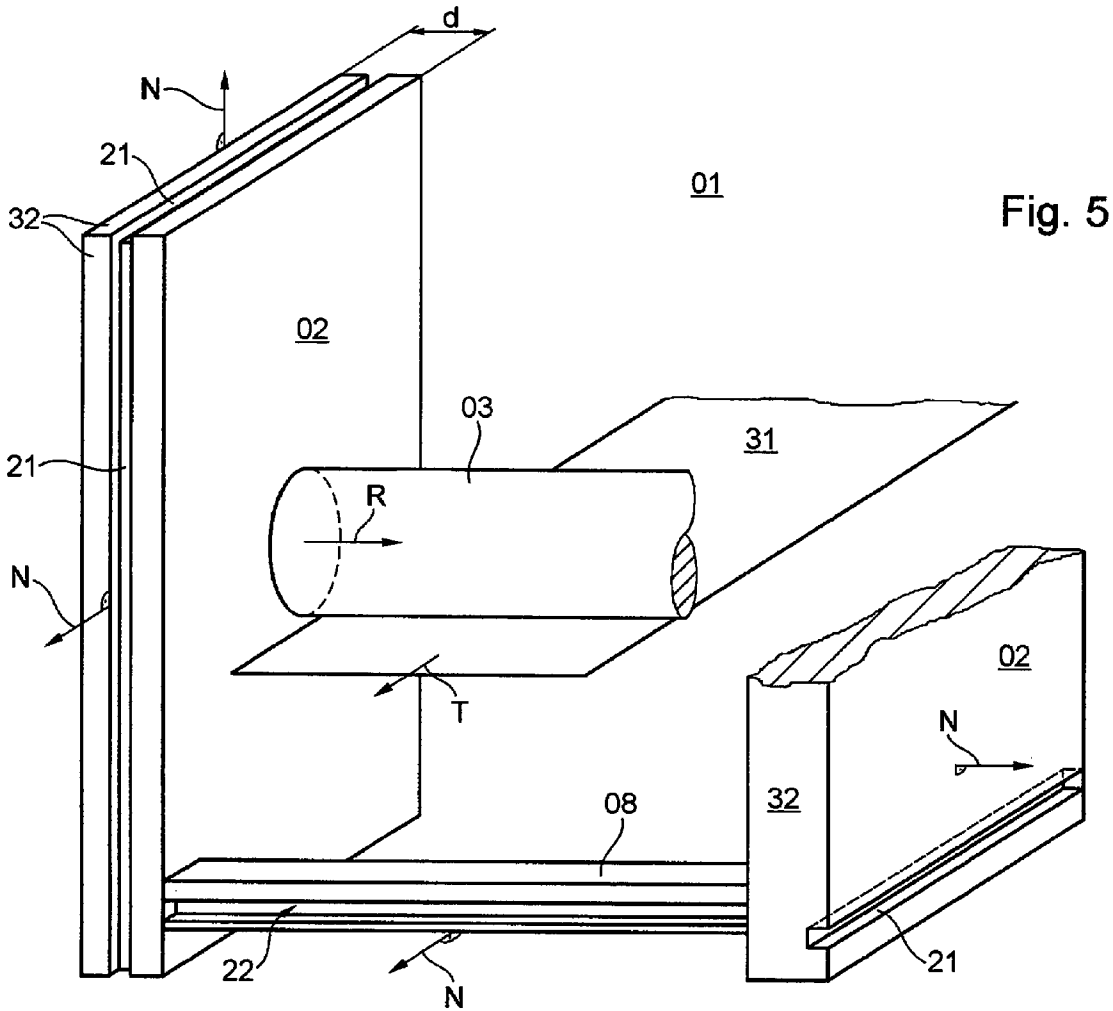
FIG. 5 a schematic illustration of a part of the machine unit of FIG. 1.

The at least one crosspiece 08 of the relevant machine unit 01 preferably extends parallel to the rotational axis R of the rotational body 03 that is disposed or at least can be disposed within the machine space. Also preferably formed inside the at least one crosspiece 08 is at least one passage 22, which is at least partially open on one of the surfaces of said crosspiece, wherein the longitudinal direction of this passage 22 extends parallel to the surface of the relevant crosspiece 08 that at least partially opens this passage 22, wherein at least one power line 38 and/or at least one data line 39 is also disposed or at least can be disposed inside this passage 22. Again, with the crosspiece 08 illustrated by way of example, a surface normal N, which extends perpendicularly on the surface that opens the relevant passage 21, is preferably positioned orthogonally to the rotational axis R of the rotational body 03, which is disposed or at least can be disposed in the machine space. In a further variant, although a passage formed in one of the frame walls 02 extends with its longitudinal direction parallel to the surface of the relevant frame wall 02 that at least partially opens this passage 21, the surface normal N that extends perpendicularly on the surface that opens the relevant passage 21 is positioned parallel to the rotational axis R of the rotational body 03 that is disposed or at least can be disposed in the machine space (FIG. 5, right frame wall 02). The passages 21; 22, which are respectively formed integrated into the frame walls 02 and the crosspiece 08, are preferably connected to one another, resulting in a self-contained, but intermeshing installation system, particularly for the installation of power lines 38 and/or data lines 39.

It can be provided that lines routed in the relevant frame walls 02 of different machine units 01 belonging to the same printing press are connected to one another or at least can be connected to one another, for example, at least at one joining site between adjacent machine units 01. Therefore, in a printing press having a plurality of machine units 01, it is preferably provided that in the respective at least one passage 21 in each at least one frame wall 02 of machine units 01 arranged adjacent to one another, at least one power line 38 and/or at least one data line 39 is disposed, wherein at least at the one joining site formed between these adjacent machine units, the power line 38 and/or data line 39 belonging to one of these machine units 01 is connected or at least can be connected to the power line 38 and/or data line 39 belonging to the respectively other machine unit 01 via a separable connecting element, for example, via a plug-type connection. In this manner, a network of lines, particularly of data and/or control lines, can be established for the relevant printing press.

Figure 6:
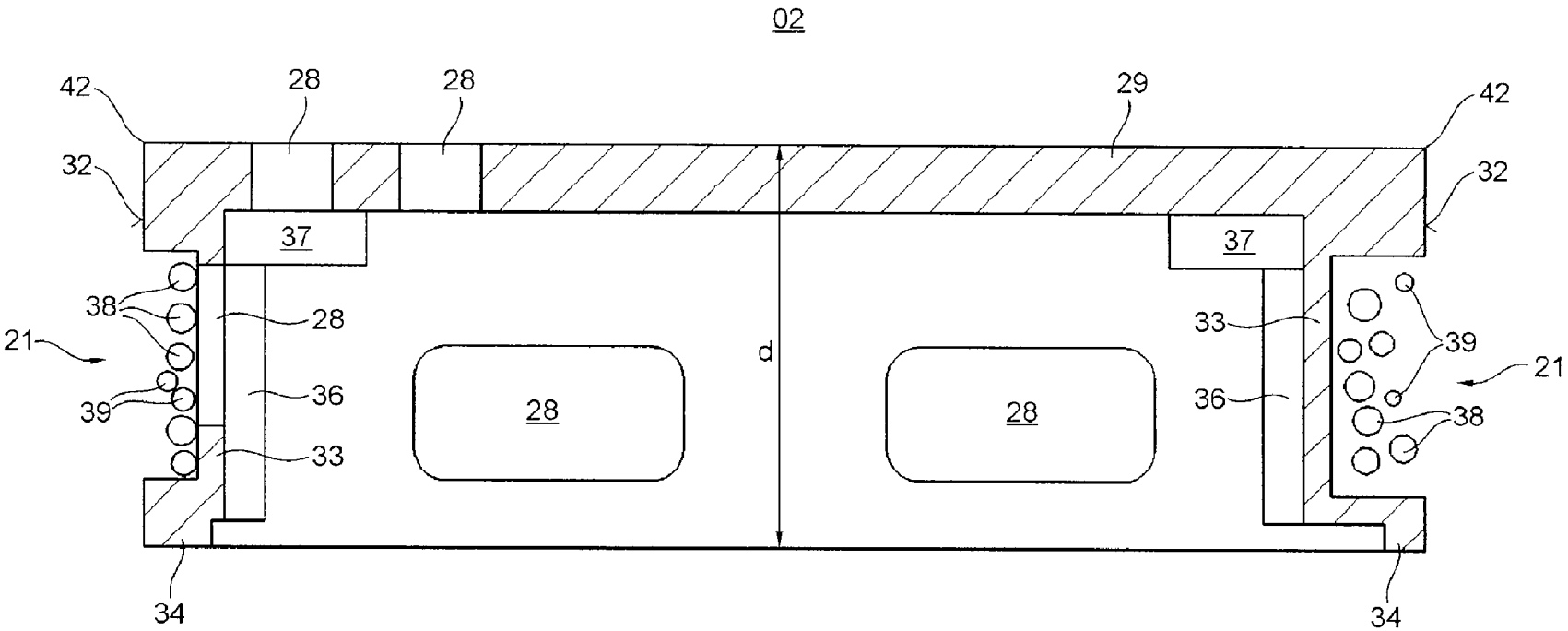
FIG. 6 a cross-section of a frame wall in a first cutting plane X-X.
Figure 7:
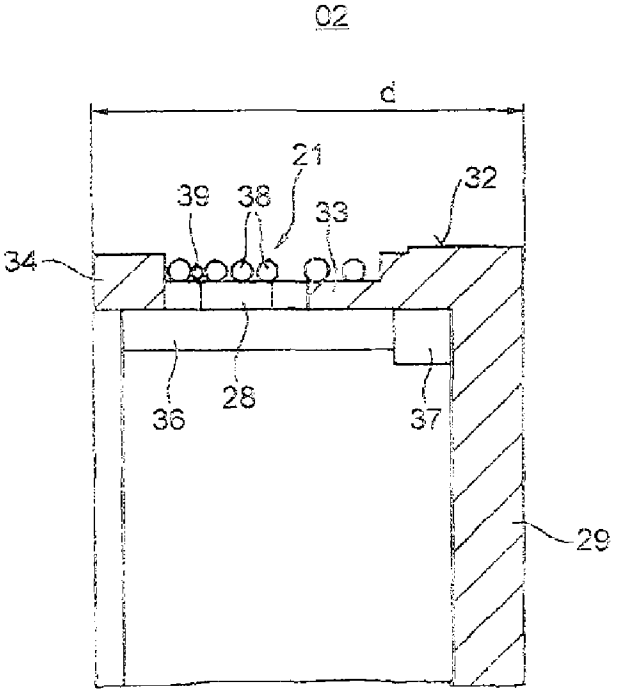
FIG. 7 a cross-section of the frame wall in a second cutting plane Y-Y.

In FIG. 3, three cutting planes X-X; Y-Y; Z-Z are indicated, which will now be specified in greater detail. The first cutting plane X-X extends longitudinally along the length l of the machine unit 01, horizontally through the frame wall 02 illustrated in the foreground in FIG. 3. A view from the bottom upward along this vertically erected frame wall 02 results in a cross-sectional illustration as shown in FIG. 6. The frame wall 02 has a panel 29 that delimits a rectangular transmission space of the machine unit 01 on multiple, for example, four, sides. This panel 29 also separates the transmission space from the machine space of this machine unit 01. Therefore, the frame wall 02 preferably is not embodied in the form of a flat panel, and instead, referred to its vertically erect operating state, a fixed member 33 that projects outward in the direction of the thickness d of this frame wall 02 is formed as a component of the panel 29 thereof that encompasses the transmission space, on or at least in the region of two of its vertical edges 42, for example, and at least one horizontal edge, wherein these fixed members 33, which preferably extend parallel to one another, reinforce the frame wall 02, which is preferably produced by casting methods, particularly in the longitudinal extension thereof, i.e., along its height (FIG. 1). Each of the fixed members 33, which are formed as narrow walls and/or projections on the panel 29 of the frame wall 02 that delimits the machine space of the machine unit 01, ends in a front frame edge 34, which is thickened in relation to the material cross-section of the relevant fixed member 33. In parallel particularly with the projecting extension of these fixed members 33, particularly on the side thereof that faces the transmission space of this machine unit 01, for example, a land 36 is formed. In the region where the respective fixed member 33 is attached to the panel 29, reinforcement elements 37 may also be formed. On the side that faces the narrow side 32 of this frame wall 02, each fixed member 33 preferably has a channel, which is recessed or formed in the relevant fixed member 33, wherein the cross-section of this channel is preferably at least partially angular, orthogonally to its longitudinal direction, wherein this channel has the function of a passage 21 formed on the relevant frame wall 02, wherein at least one power line 38 and/or at least one data line 39 is laid or at least can be laid in this passage 21, which lines are illustrated by way of example in FIGS. 6 to 8 as each having a circular cross-section. Both the panel 29 that separates the transmission space from the machine space, for example, and the fixed members 33 can each have at least one opening 28, through which at least one stub line, for example, which is connected to the at least one power line 38 or to the at least one data line 39, can be routed.

FIG. 7 again illustrates a section of a cross-section through the frame wall 02 illustrated in the foreground in FIG. 3, wherein this second cutting plane Y-Y extends horizontally, parallel to the width b of the machine unit 01, and is thereby orthogonal to the length l (FIG. 1) of this frame wall 02. The fixed member 33 located on the vertical panel 29 is equipped on its side that faces toward the narrow side 32 of this frame wall 02, i.e., on its side that faces outward, with a channel extending in the direction of the length l of this frame wall 02, which channel can be used as a passage 21 for laying at least one power line 38 and/or at least one data line 39. The fixed member 33 in turn ends in a front frame edge 34, which is thickened in relation to the material cross-section of the fixed member 33. Particularly in parallel with the projecting extension of this fixed member 33, particularly on the side that faces the transmission space of this machine unit 01, for example, a land 36 can be formed, for example. In the region where this fixed member 33 is attached to the panel 29, a reinforcement element 37 may also be formed. The fixed member 33 can have at least one opening 28 between the passage 21 thereof and, for example, the transmission space, through which opening, for example, at least one stub line, which is connected to the at least one power line 38 or to the at least one data line 39, can be routed. As is clear from FIG. 3, the thickened front frame edge 34 is preferably embodied as a continuous edge that surrounds this frame wall 02 on, for example, three of its sides, and the passages 21 formed in the relevant three fixed members 33, for example, are similarly connected to one another and are therefore preferably embodied as continuous.

Figure 8:
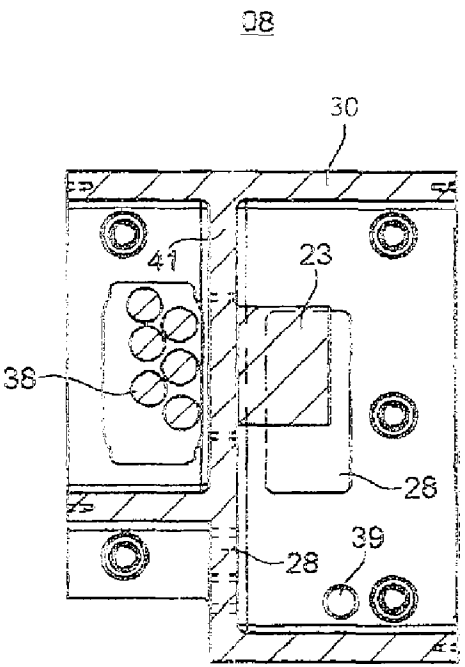
FIG. 8 a cross-section of the crosspiece in a third cutting plane Z-Z.

FIG. 8 shows a cross-section of one of the crosspieces 08 of the frame of a machine unit 01, illustrated in FIG. 3, wherein this third cutting plane Z-Z extends vertically along the height h of this machine unit 01, and is therefore orthogonal to the inside width w (FIG. 1) between the frame walls 02 of this frame. The crosspiece 08, which is preferably produced by casting methods, has, for example, a plurality of chambers extending in the longitudinal direction of this crosspiece 08 (FIGS. 2 to 4), which chambers are separated from one another by a dividing wall 41 extending along the crosspiece 08, wherein in a front chamber in FIG. 3, for example, at least one control unit 23 and/or at least one data line 39 is disposed or at least can be disposed, and in a rear chamber in FIG. 3, the inside of which is not visible in this figure, for example, at least one power line 38 and/or at least one data line 39 is disposed or at least can be disposed. The profile of the crosspiece 08 can be embodied in the shape of a double-T support, for example. The dividing wall 41, which extends lengthwise through the crosspiece 08, and the remaining walls 30 of the crosspiece 08 have, for example, at least one opening 28, through which, for example, at least one stub line, which is connected to the at least one power line 38 or to the at least one data line 39, is routed or at least can be routed for connection of the at least one control unit 23, for example.

In a plurality of the passages 21; 22 embodied as continuous in the frame of the same machine unit 01, at least one loop line can be formed, which is used by a centrally supplied automatic or manual lubricating device, for example, or at least can be used by such a device.

While a preferred embodiment of a printing press having at least one machine unit, in accordance with the present invention, has been set forth fully and completely hereinabove, it will be apparent to one of skill in the art that various changes in, for example, the specific structure of the printing units or other machine units located in the printing machine, the specific drives for those printing or other machine units and the like could be made without departing from the true spirit and scope of the present invention which is according to be limited only by the appended claims.

The invention claimed is:

1. A printing press comprising:

at least one machine unit (01) in said printing press and having at least one frame wall (02) supporting printing couple cylinders and that delimits a machine space of said machine unit (01), wherein said at least one frame wall has a frame wall thickness (d), a frame wall height (h) and a frame wall length (l), said frame wall thickness (d) being less than said frame wall height (h) and said frame wall length (l);

a narrow side of said at least one frame wall;

at least one surface of said narrow side of said at least one frame wall (02), which said at least one surface has a surface longitudinal direction transverse to said frame wall thickness (d); and wherein said at least one surface has at least one passage (21) which is embodied as a recessed channel that is at least partially open, wherein the opening of said channel extends in said surface in said surface longitudinal direction and further, wherein at least one of at least one power line (38) and at least one data line (39) is disposed within this passage (21).

2. The printing press according to claim 1, characterized in that the at least one frame wall (02) is made of a cast material.

3. The printing press according to claim 1, characterized in that in this printing press, a plurality of machine units (01) are arranged in a row in a direction of transport (T) of a print substrate (31), wherein the machine units (01) belonging to this printing press are embodied such that each of them is capable of executing at least one specific step in one of a processing and production process to be carried out by this printing press.

4. The printing press according to claim 1, characterized in that at least one cylindrical rotational body (03), the outer surface of which is one of involved and at least can be involved in the process of processing a print substrate (31) that is guided through the printing press, is one of disposed and at least can be disposed in the machine space of the at least one machine unit (01), wherein the rotational axis (R) of the rotational body (03) extends within the machine space of this machine unit (01).

5. The printing press according to claim 4, characterized in that a surface normal (N) of the narrow side (32) is positioned orthogonally to the rotational axis (R) of the rotational body (03) which is one of disposed and at least can be disposed in the machine space.

6. The printing press according to claim 4, characterized in that the rotational body (03) that is one of disposed and at least can be disposed in the machine space of the at least one machine unit (01) is embodied as one of a printing couple cylinder and as a roller of one of an inking unit (04) and a dampening unit.

7. The printing press according to claim 1, characterized in that the at least one machine unit (01) is embodied as one of a printing unit and as an infeed unit and as a coating unit and as a folding apparatus and as a reel changer of the printing press.

8. The printing press according to claim 1, further including at least one second frame wall (02), said two frame walls (02) being disposed opposite one another at a distance to delimit the machine space of the said machine unit (01), wherein at least one crosspiece (08) that bridges the distance (w) is disposed between said two frame walls (02).

9. The printing press according to claim 8, characterized in that the at least one crosspiece (08) extends parallel to a rotational axis (R) of a rotational body (03) that is one of disposed and at least can be disposed in the machine space.

10. The printing press according to claim 8, characterized in that within the at least one crosspiece (08), at least one passage (22) is formed, at least partially open on the surface of said at least one crosspiece, wherein this at least one passage (22) extends with its longitudinal direction parallel to the surface of the at least one crosspiece (08) that at least partially opens said at least one passage (22).

11. The printing press according to claim 10, characterized in that at least one of at least one power line (38) and at least one data line (39) is one of disposed and at least can be disposed inside the passage (22) in the relevant crosspiece (08).

12. The printing press according to claim 11, characterized in that at least one stub line is provided, which branches off of one of the at least one power line (38) and data line (39) disposed in the at least one passage (22) that is formed within the crosspiece (08).

13. The printing press according to claim 10, characterized in that at least one of a control unit (23) and at least one operating unit (24) and at least one display unit (26) are provided, wherein said one of said control unit (23) and operating unit (24) and display unit (26) are positioned one of at least partially inside the passage (21) in the at least one frame wall (02) and inside the passage (22) in the at least one crosspiece (08).

14. The printing press according to claim 10, characterized in that the at least one passage (21) formed in one of the frame walls (02) and the at least one passage (22) in the at least one crosspiece (08) are connected continuously to one another.

15. The printing press according to claim 10, characterized in that the at least one passage (22) in the at least one crosspiece (08) is separated by a panel (30) from the machine space of the machine unit (01).

16. The printing press according to claim 10, characterized in that the at least one passage (22) in the at least one crosspiece (08) has at least one opening (28) to a control cabinet (07), which is located on one of one of the frame walls (02) that are connected to this crosspiece (08), and to a unit, which is located in the machine unit (01) having this frame wall (02).

17. The printing press according to claim 10, characterized in that the at least one passage (22) in the at least one crosspiece (08) is covered by a removable cover (27).

18. The printing press according to claim 10, characterized in that in the at least one passage (21; 22) formed within one of the frame wall (02) and at least one crosspiece (08), a dividing wall is provided, which divides the respective passage (21; 22) longitudinally into two partial passages, wherein at least one line for one of conducting electric power and for transmitting an electric signal is disposed in the one partial passage, and at least one line for conducting a fluid is disposed in the other partial passage.

19. The printing press according to claim 10, characterized in that at least one control unit (23) for one of controlling one of a pneumatically operated operating cylinder and control cylinder and for controlling at least one pneumatically operated roller lock is located in the at least one passage (22) of the crosspiece (08).

20. The printing press according to claim 19, characterized in that the at least one control unit (23) for controlling pneumatically operated roller locks, disposed at different ends of a rotational body (03), is located in the at least one passage (22) of the cross member (08) at a position ranging from 40% to 60% of a distance (w) between the frame walls (02) that delimit the machine space of the relevant machine unit (01).

21. The printing press according to claim 10, characterized in that in a plurality of said passages (21; 22) belonging to the same machine unit (01), at least one loop line is formed, which is used by a lubricating device.

22. The printing press according to claim 8, characterized in that the at least one crosspiece (08) is made of a cast material.

23. The printing press according to claim 8, characterized in that the at least one passage (22) formed inside the at least one crosspiece (08) is formed by casting.

24. The printing press according to claim 8, characterized in that the at least one crosspiece (08) has a plurality of chambers, wherein one of at least one control unit (23) and at least one data line (39) are disposed in one of these chambers, and at least one power line (38) is disposed in another one of these chambers.

25. The printing press according to claim 8, characterized in that at least one of the at least one frame wall (02) and the at least one crosspiece (08) are made of cast iron.

26. The printing press according to claim 1, characterized in that the at least one passage (21) formed in the frame wall (02) is separated by a panel (29) from the machine space of the machine unit.

27. The printing press according to claim 1, characterized in that the at least one passage (21) formed in the frame wall (02) has at least one opening (28) to one of a control cabinet (07) located on this frame wall (02) and to a unit located in the machine unit (01) having this frame wall (02).

28. The printing press according to claim 1, characterized in that the at least one passage (21) formed in the frame wall (02) is covered by a removable cover (27).

29. The printing press according to claim 1, characterized in that the at least one passage (21) formed inside the frame wall (02) is formed by casting.

30. The printing press according to claim 1, characterized in that the power line (38) is embodied as one of a cable for conducting electric power and a line for conducting fluid.

31. The printing press according to claim 1, characterized in that the data line (39) is embodied as line for transmitting a signal one of electrically and optically and pneumatically.

32. The printing press according to claim 1, characterized in that at least one stub line is provided, which branches off of the one of the at least one power line (38) and the data line (39) disposed in the passage (21) that is formed within the frame wall (02).

33. The printing press according to claim 1, characterized in that the frame wall (02) has at least one fixed member (33) projecting outward in the direction of the thickness (d) of said frame wall, in which fixed member the at least one passage (21) for routing at least one of one power line (38) and at least one data line (39) is formed.

34. The printing press according to claim 33, characterized in that the fixed member (36) ends in a front frame edge (34), which is thickened in relation to its material cross-section.

35. The printing press according to claim 34, characterized in that the front frame edge (34), which is embodied as thicker on multiple edges, is embodied as a continuous edge that surrounds this frame wall (02).

36. The printing press according to claim 33, characterized in that the fixed member (33) extends at least along an edge which extends in the direction of the height (h) of the vertical frame wall (02).

37. The printing press according to claim 33, characterized in that one fixed member (33) extends along each of two edges that run in the direction of the height (h) of the same vertical frame wall (02), and along at least one edge that runs in the direction of the length (l) of said frame wall (02).

38. The printing press according to claim 1, characterized in that the at least one frame wall (02) is embodied as an upright, rectangular geometric body wherein the frame wall thickness (d) is less than 20% of a width (b) of the machine unit (01) having this frame wall (02).

39. The printing press according to claim 1, characterized in that the frame wall thickness (d) of the at least one frame wall (02) is oriented in the direction of a width (b) of the machine unit (01) having this at least one frame wall (02).

40. The printing press according to claim 1, characterized in that a width (b) of the machine unit (01) having the at least one frame wall (02) is oriented transversely to a direction of transport (T) of a print substrate (31) that is one of guided and at least can be guided through the printing press.

41. The printing press according to claim 1, characterized in that a plurality of machine units (01) are provided, wherein in the at least one passage (21) in at least one frame wall (02) of each of the adjacent machine units (01), one of at least one power line (38) and at least one data line (39) are disposed, wherein at least at one joining site formed between these adjacent machine units (01), at least one of the power line (38) and the data line (39) belonging to one of these machine units (01) is one of connected to at least one of the power line (38) and the data line (39) belonging to the respectively other machine unit (01), and at least can be connected to one another, by means of a separable connecting element.

42. The printing press according to claim 41, characterized in that a plug connector is provided as the connecting element.

* * * * *